US010801438B2

(12) United States Patent
Geissler et al.

(10) Patent No.: US 10,801,438 B2
(45) Date of Patent: Oct. 13, 2020

(54) METHOD FOR PRODUCING A PISTON

(71) Applicant: Mahle International GmbH, Stuttgart (DE)

(72) Inventors: Christof Geissler, Freudenstadt (DE); Jochen Kortas, Murr (DE)

(73) Assignee: MAHLE INTERNATIONAL GMBH (DE)

( * ) Notice: Subject to any disclaimer, the term of this patent is extended or adjusted under 35 U.S.C. 154(b) by 99 days.

(21) Appl. No.: 16/028,361

(22) Filed: Jul. 5, 2018

(65) Prior Publication Data

US 2019/0010891 A1 Jan. 10, 2019

(30) Foreign Application Priority Data

Jul. 5, 2017 (DE) ..... 10 2017 211 480

(51) Int. Cl.
*F02F 3/00* (2006.01)

(52) U.S. Cl.
CPC ..... *F02F 3/003* (2013.01); *F02F 2003/0053* (2013.01)

(58) Field of Classification Search
CPC .. F02F 3/003; F02F 2003/0053; B23K 31/02; B23K 37/00; B23P 15/10
See application file for complete search history.

(56) References Cited

U.S. PATENT DOCUMENTS 7,971,355 B2 * 7/2011 Scharp ..... F02F 3/003 29/418
8,991,046 B2 3/2015 Schulz et al.
2008/0314240 A1 * 12/2008 Walker ..... B22F 5/008 92/186
2011/0197845 A1 * 8/2011 Flowers ..... F02F 3/22 123/193.6
2012/0080004 A1 * 4/2012 Menezes ..... F02F 3/22 123/193.6
2012/0222645 A1 * 9/2012 Edel ..... F02F 3/003 123/193.6
2015/0226151 A1 * 8/2015 Emmerich ..... F01P 3/06 123/41.16
2016/0061326 A1 * 3/2016 Weiss ..... F02F 3/22 92/260

FOREIGN PATENT DOCUMENTS

DE 10 2009 032 941 A1 1/2011

* cited by examiner

*Primary Examiner* — Hung Q Nguyen
(74) *Attorney, Agent, or Firm* — Fishman Stewart PLLC

(57) ABSTRACT

A method for producing a piston may include producing a piston top part and a piston bottom part each including an inner support element having an inner joining surface and an outer support element having an outer joining surface. At least one of the joining surfaces may include a solder depository. The method may also include pre-machining at least one of the joining surfaces and introducing a high-temperature soldering material in at least one solder depository. The method may further include assembling the piston top part and the piston bottom part to form a piston body via creating at least one of circular contact and linear contact between the joining surfaces such that a gap width is 20 μm to 150 μm. The method may also include transferring the piston body into a soldering oven, melting the high-temperature soldering material via heating the piston body, and cooling the piston body.

20 Claims, 2 Drawing Sheets

METHOD FOR PRODUCING A PISTON

CROSS-REFERENCE TO RELATED APPLICATIONS

This application claims priority to German Patent Application No. DE 10 2017 211 480.0, filed on Jul. 5, 2017, the contents of which are hereby incorporated by reference in its entirety.

TECHNICAL FIELD

The present invention relates to a method for producing a piston consisting of a piston top part and a piston bottom part each having an inner support element and an outer support element. The invention also relates to a piston which is produced by this method and also to an internal combustion engine having such a piston.

BACKGROUND

A generic method for producing a multi-part piston for an internal combustion engine by means of the following method steps is known from DE 10 2009 032 941 A1: producing a piston top part and a piston bottom part each having an inner support element with joining surfaces and having an outer support element with joining surfaces, applying a high-temperature soldering material in the region of at least one joining surface, assembling the piston top part and the piston bottom part, forming a piston body, by creating a contact between the joining surfaces, transferring the piston body into a vacuum oven and evacuating the vacuum oven, heating the piston body at a pressure of at $10^{-2}$ mbar maximum to a soldering temperature of 1300° C. maximum, and cooling the soldered piston until the high-temperature soldering material has fully solidified. By means of the known soldering method, the intention is for the possibility of a reliable soldered connection between a piston top part and a piston bottom part to be ensured at the lowest possible cost.

In the case of the soldering method known from the prior art, a soldering material is applied to joining surfaces, wherein these joining surface are orientated parallel to each other and therefore butt flat against each other in the joined state. In this case, however, the problem of the so-called "zero gap" arises, which zero gap is created if two pre-machined joining surfaces butt exactly parallel and therefore flat against each other and as a consequence the solder cannot spread out evenly, or in the worst case not spread out all, as a result of which defects and also a poor or even absent material bond between the two parts occur.

SUMMARY

The present invention therefore deals with the problem, for a method of the generic type, of specifying an improved embodiment or at least one alternative embodiment which overcomes the disadvantages known from the prior art, especially the disadvantages in relation to the so-called "zero gap".

This problem is achieved according to the invention by means of the subject matter of the independent claim(s). Advantageous embodiments are the subject matter of the dependent claim(s).

The present invention is based on the general idea of providing a defined soldering gap between two components which are to be interconnected, which soldering gap ensures a reliable and process-safe soldering. In the method according to the invention, a piston top part, having an inner support element with an inner joining surface and having an outer support element with an outer joining surface, is first of all produced or made available. In the same way, a piston bottom part having an inner support element with an inner joining surface and having an outer support element with an outer joining surface is also made available, wherein at least one solder depository is introduced in at least one inner joining surface and/or in at least one outer joining surface. A high-temperature soldering material is then introduced into this at least one solder depository. After this, assembling of the piston top part and the piston top part is carried out, forming a piston body, wherein between the respective inner joining surfaces and the respective outer joining surfaces a ring-like contact is made in each case. The two piston parts are therefore in contact via circular lines. A flat contact between the joining surfaces, as is known from the prior art for example, can be avoided as a result of this. A gap width between two oppositely disposed joining surfaces is 20 μm minimum and 150 μm maximum in this case, as a result of which the risk of the previously occurring zero gap and of the possibly poor soldered joint associated with this can be avoided. For this purpose, the respective joining surfaces of the piston top part and/or of the piston bottom part are pre-machined in such a way that in the joined together state these do not butt flat against each other, forming a zero gap. Therefore, at least one inner joining surface and/or at least one outer joining surface of the piston top part or of the piston bottom part lies obliquely to the corresponding joining surface of the piston bottom part or of the piston top part. The gap which remains between two associated joining surfaces is therefore in the shape of a wedge for example. The piston body is now transferred into a soldering oven and soldered there at a temperature of 1,300° C. maximum, as a result of which the high-temperature soldering material melts and creates a materially bonding connection between the joining surfaces of the piston top part and of the piston bottom part. The soldered piston body or piston is then cooled until the high-temperature soldering material has completely solidified. This piston body or piston can subsequently additionally be sent for aftermachining, e.g. for a cutting or grinding process. By the provision of the defined soldering gap as a result of the design of the predefined joining surfaces, a controlled utilisation of the capillary effect and also a guarantee of a complete wetting of the entire joining surfaces can be achieved, as a result of which defects, as can frequently occur in the case of "zero gap" joining surfaces, can be reliably avoided. Depending on the soldering gap geometry, a desired or predefined soldered seam geometry can also be created in the process, as a result of which for example a wider side of the soldering gap can be located where a lower loading is applied to the piston. Moreover, depending on the arrangement of the solder depository, the flow direction or the utilisation of the capillary effect in a specific direction can be controlled. By means of the method according to the invention, it is therefore possible in the first instance to produce a multi-part piston, that is to say a piston consisting of at least one piston top part and one piston bottom part joined by soldering, in a process-safe and qualitatively high-value manner. As a result of the selected gap width w between 20 μm<w<150 μm, a particularly good and uniform wetting of the entire joining surfaces can furthermore be achieved, which also contributes to an optimum soldered joint and therefore to a high quality of the produced piston.

In an advantageous development of the solution according to the invention, an assembling of piston top part and piston bottom part, forming the previously described piston body or piston, is carried out by creating a linear and especially also circular contact between the respective inner joining surfaces and the respective outer joining surfaces, wherein a gap width w is between 20 μm<w<80 μm. This again constitutes a slight limitation of the gap width described in the previous paragraph, wherein it has been demonstrated in trials that a gap width which is limited to a gap width w of 80 μm maximum enables a particularly loadable soldered joint.

During the soldering process, a pressure of at most $10^{-2}$ mbar is expediently created in the soldering oven. This presents the great advantage that by creating the negative pressure substances which hinder the soldering process, such as gas constituents, can be removed and consequently a negative impact upon the soldered connection can be excluded.

The present invention is furthermore based on the general idea of introducing a piston which is produced according to this method, wherein this piston, on account of the soldering gap designed according to the invention, enables a particularly reliable, loadable and process-safe soldered joint.

In an advantageous development of the piston according to the invention, two solder depositories are arranged in one joining surface. Naturally, one or more solder depositories can be arranged in one or more joining surfaces in this case, depending on the desired amount of solder, particularly also in order to be able to control a flow of the soldering material in a better way. Purely theoretically, it is naturally also conceivable that the solder depository is not introduced inside a joining surface, but for example introduced on a widened lower joining surface, the projection of which is then removed by cutting.

In an advantageous development of the solution according to the invention, one joining surface extends perpendicularly to a piston axis or perpendicularly to the piston axis in a radially encompassing manner, whereas the other, oppositely disposed joining surface extends obliquely to the piston axis. As a result of this, a wedge shape of the soldered seam which is to be produced can be achieved, wherein naturally other shapes of the soldered seam also conceivable. For example, one joining surface can also extend radially to a piston axis, whereas the other joining surface is of kinked design, that is to say in the manner of a groove, for example. In the kink, provision is preferably made for the solder depository in this case, wherein naturally on such a joining surface a plurality of grooves, which are of radially different size and are radially spaced apart, each channel having a solder depository, can also be arranged. This presents the particular advantage that a plurality of ring-like or circle-like soldered seams between piston top part and piston bottom part can be created and therefore a particularly loadable soldered connection between the piston top part and the piston bottom part can be created.

In a further advantageous embodiment of the solution according to the invention, one joining surface extends perpendicularly to a piston axis, whereas the other joining surface is of concave or convex design. Also as a result of this, an initially only circular contact between the two piston parts can be created, wherein in the case of a concave design of a joining surface two linear contact rings are provided, in the same way as in the case of a convexly designed joining surface, providing a solder depository is arranged in this in the contact zone at the same time. The convex shape presents the advantage of an especially clean transition between the joining surfaces and on the inside forms advantageous solder meniscuses in the region of contact of the two joining surfaces. The concave shape leads to narrow advantageous soldered seams in the highly loaded edge region of the support elements.

The present invention is furthermore based on the general idea of equipping an internal combustion engine with at least one piston which is produced according to the preceding method, as a result of which a weight-optimised and highly loadable internal combustion engine is made possible.

Further important features and advantages of the invention are gathered from the dependent claims, from the drawings and from the associated figure description based on the drawings.

It is understood that the aforesaid features and the features which are still to be explained below can be applied not only in the respectively specified combination but also in other combinations or on their own without departing from the scope of the present invention.

Preferred exemplary embodiments of the invention are represented in the drawings and are explained in more detail in the following description, wherein the same designations refer to the same or similar or functionally the same components.

BRIEF DESCRIPTION OF THE DRAWINGS

In the drawing, schematically in each case.

DETAILED DESCRIPTION

Figure 1:
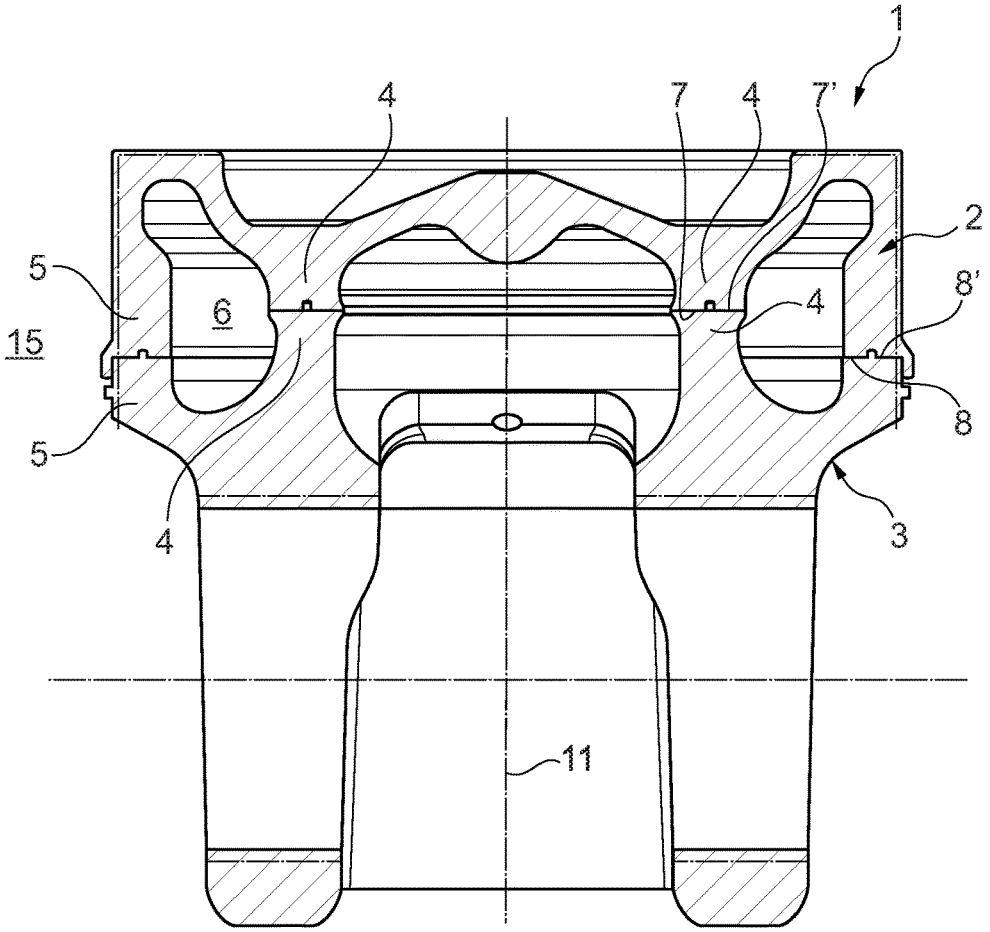
FIG. 1 shows a sectional view through a piston according to the invention.

Shown in accordance with FIG. 1 is a piston 1 according to the invention which has a piston top part 2 and a piston bottom part 3. The piston top part 2 has in this case an inner support element 4 and an outer support element 5, in the same way as the piston bottom part 3. The piston top part 2 is supported in this case via its inner support element 4 in relation to the inner support element 4 of the piston bottom part 3 and by its outer support element 5 is supported in relation to the outer support element 5 of the piston bottom part 3. A cooling channel 6 is included in this case between the inner support elements 4 and the outer support elements 5. According to the invention, the piston top part 2 is now supported by its inner support element 4, via an inner joining surface 7, on an associated inner joining surface 7' of the inner support element 4 of the piston bottom part 3. In the same way, the piston top part 2 is supported by its outer support element 5, via an outer support surface 8, in relation to an outer support surface 8' of the outer support element 5 of the piston bottom part 3. A soldering gap 9 (cf. FIGS. 2 to 10) is formed in this case between the respectively oppositely disposed joining surfaces 7, 7' and 8, 8'.

The respective joining surfaces 7, 7', 8, 8' of the piston top part 2 and/or of the piston bottom part 3 are produced, especially angled, in this case in such a way that in the joined together state these do not butt flat against each other, forming a zero gap. The soldering gap 9 is therefore wedge shaped, for example.

The described piston top part 2 and piston bottom part 3 can naturally be referred to a first and a second piston part so that the first piston part represents for example a piston basic body and the second piston part represents for example a ring belt.

The piston 1 according to the invention is now produced by means of a production method according to the invention which is divided into the following method steps: first of all the piston top part 2 and the piston bottom part 3, each having an inner support element 4 with inner joining surfaces 7, 7' and each having an outer support element 5 with outer joining surfaces 8, 8' are produced, wherein at least one solder depository 10 (cf. FIGS. 2 to 10) is introduced in at least one inner joining surface 7, 7' and/or in at least one outer joining surface 8, 8'. Purely theoretically, the solder depository 10 according to FIGS. 2 to 10 is always arranged in this case in the region of the respective joining surface 7, 7', 8, 8', wherein it is naturally also conceivable that one of the joining surfaces 7, 7', 8, 8' extends in the radial direction, that is to say extends orthogonally to a piston axis 11 and the solder depository 10 is arranged there. In this case, the radially extended joining surface 7, 7', 8, 8' would then be removed after soldering by means of for example a metal cutting process.

A high-temperature soldering material 12 is now introduced in at least one solder depository 10. The piston top part 2 is now assembled with the piston bottom part 3, forming a piston body or the piston 1, and in the process at least one circular and linear contact 13 between the respective inner joining surfaces 7, 7' and the respective outer joining surfaces 8, 8' is created, wherein a gap width w lies between 20 μm<w<150 μm, preferably between 20 μm<w<80 μm. In this case, at least one inner joining surface 7, 7' and/or at least one outer joining surface 8, 8' of the piston top part 2 and/or of the piston bottom part 3 lies obliquely to the corresponding joining surface 8, 8', 7' 7' of the piston bottom part 3 or of the piston top part 2. The soldering gap 9 which remains between two associated joining surfaces 7, 7' and 8, 8' is therefore wedge-shaped at least in sections. The piston 1 is now transferred into a soldering oven and heated there to a soldering temperature of 1300° C. maximum, usually to a soldering temperature of between 1010° C. and 1180° C. and consequently the high-temperature soldering material 12 is melted. As a result of the melting of the soldering material 12, this is distributed inside the soldering gap 9 and on account of capillary effects penetrates even into the smallest of gaps. By means of the only linear or circular contact between two oppositely disposed joining surfaces 7, 7' and 8, 8' zero gaps which previously often occurred are avoided and as a result the connection quality is significantly increased.

During the soldering process in the soldering oven, a pressure of for example $10^{-2}$ mbar maximum is furthermore created, wherein by evacuating the soldering oven gases which can negatively influence the soldering process can especially also be removed and as a result can enhance the quality of the soldered connection.

In FIGS. 2 to 10, the joining surfaces are in each case designated 7, 7' or 8, 8', wherein it is obviously clear that these occur alternatively only in association with the respectively associated inner or outer support element 4, 5.

Figure 2:
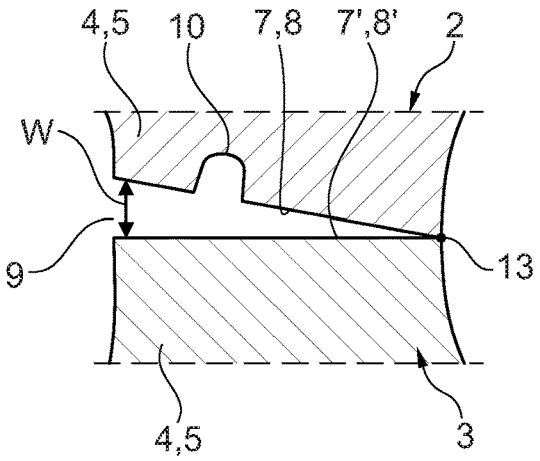
FIG. 2 shows a detailed view from FIG. 1 in the region of two opposite disposed joining surfaces with one joining surface extending perpendicularly to a piston axis and one joining surface extending obliquely to a piston axis.
Figure 3:
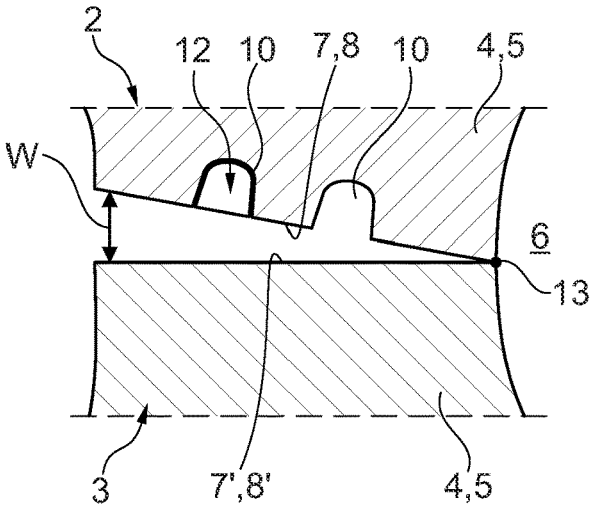
FIG. 3 shows a view as in FIG. 2, but with two solder depositories in the oblique joining surface.

If consideration is now given to the individual soldering gaps 9, then according to FIG. 2 a soldering gap 9 which is formed by two oppositely disposed joining surfaces 7, 7' and 8, 8' can be seen, wherein one joining surface 7', 8' extends perpendicularly to a piston axis 11 or perpendicularly to a piston axis 11 in a radially encompassing manner, whereas the other joining surface 7, 8 extends obliquely to the piston axis 11. One solder depository 10 is arranged in this case in the joining surface 7, 8 which extends obliquely to the piston axis 11. In the case of the soldering gap 9, in this case it can be a soldering gap between the inner support elements 4 or the outer support elements 5. If consideration is given to the soldering gap 9 according to FIG. 3, then this in the main is similarly designed with the soldering gap 9 according to FIG. 2, wherein, however, two solder depositories 10 are arranged on the joining surface 7, 8.

Figure 4:
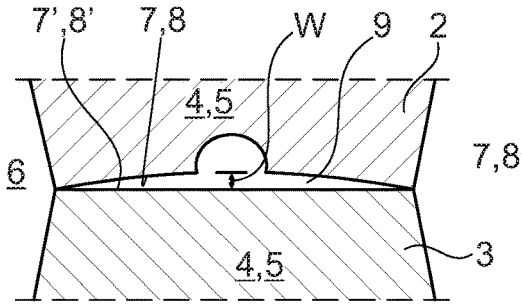
FIG. 4 shows one joining surface extending perpendicularly to the piston axis and one concave oppositely disposed joining surface.
Figure 5:
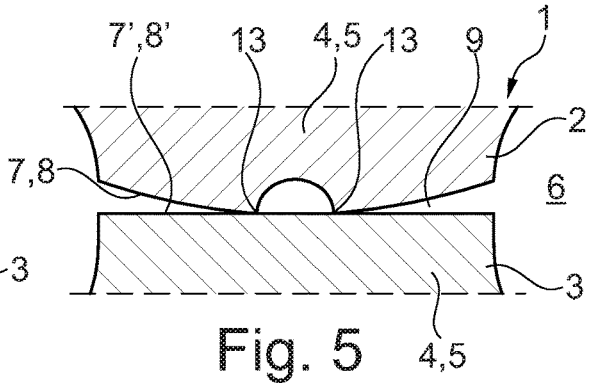
FIG. 5 shows a view as in FIG. 4, but with one convex joining surface.

If consideration is given to the soldering gaps 9 according to FIGS. 4 and 5, then it can be seen that the joining surface 7', 8' extends perpendicularly to the piston axis 11 there, whereas the oppositely disposed joining surface 7, 8 in the case of FIG. 4 is of concave design and in the case of FIG. 5 is of convex design. In both cases, however, a linear contact 13 is formed between the two joining surfaces 7, 7' or 8, 8'.

Figure 6:
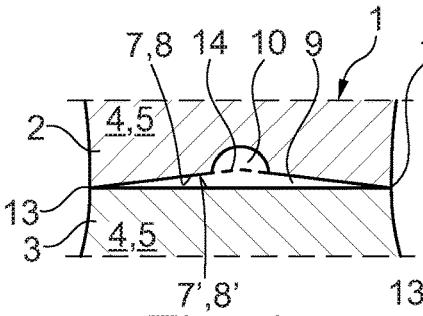
FIG. 6 shows a detailed view from FIG. 1 with one joining surface extending perpendicularly to the piston axis and one oppositely disposed groove-like joining surface with a solder depository.
Figure 7:
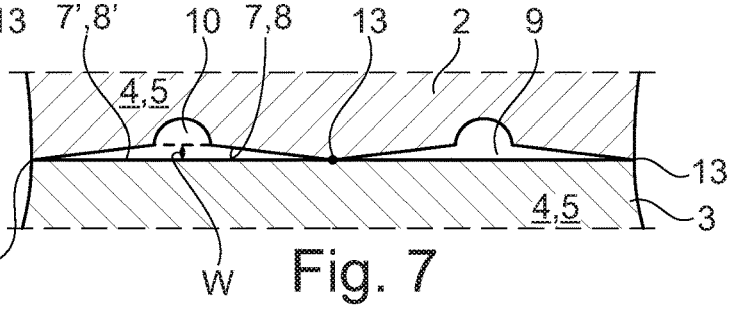
FIG. 7 shows a view as in FIG. 6, but with two groove-like joining surfaces.

Shown according to FIG. 6 is a soldering gap 9 the joining surface 7', 8' of which again extends perpendicularly to the piston axis 11, like in FIG. 7, whereas the other joining surface 7, 8 is of kinked design and in the region of a kink 14, which according to FIG. 6 is shown only by a discontinuously drawn line, has a solder depository 10. The soldering gap 9 according to FIG. 7 is also designed in the same way, wherein in this case two kinked joining surfaces 7, 8 are provided.

Figure 8:
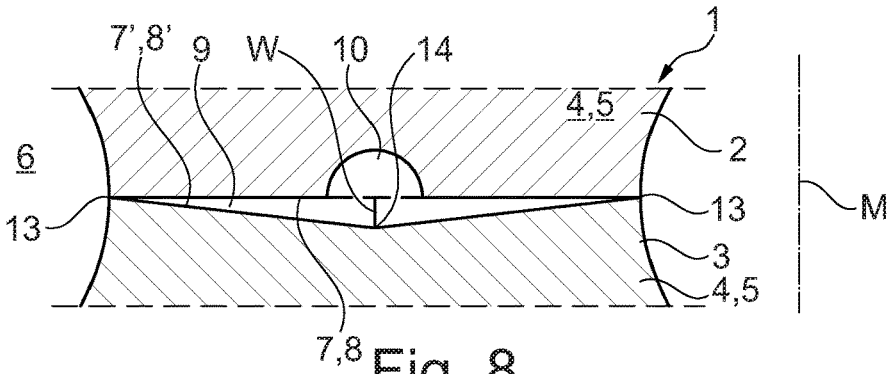
FIG. 8 shows a modification from FIG. 6.

If consideration is given to FIG. 8, then in the soldering gap 9 shown there the joining surface 7, 8 is orientated perpendicularly to the piston axis 11, whereas the oppositely disposed joining surface 7', 8' is of kinked design. The solder depository 10 is in this case, however, arranged in the region of the radially orientated joining surface 7, 8 opposite the kink 14.

Figure 9:
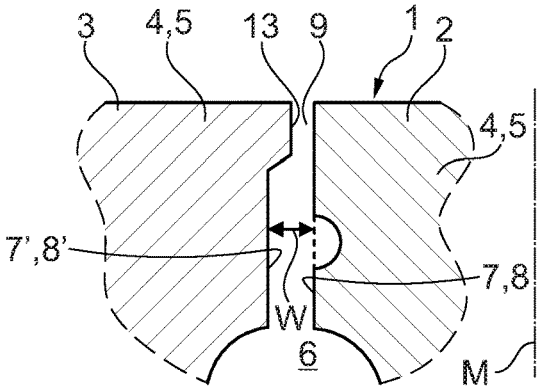
FIG. 9 shows joining surfaces extending parallel to a piston axis, with a defined local projection.
Figure 10:
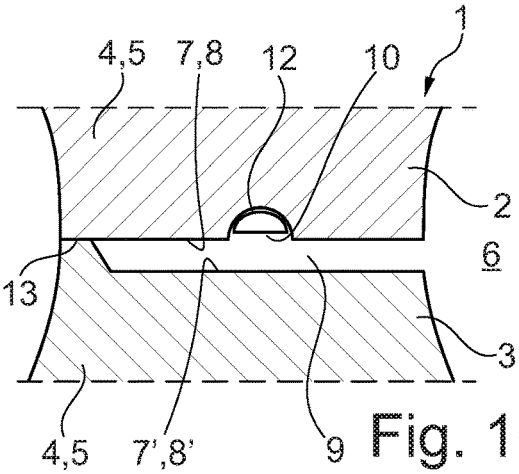
FIG. 10 shows a view rotated by 90° in relation to FIG. 9, with radially extending joining surfaces with a local projection.

If consideration is finally given to FIG. 9, then a soldering gap 9 which extends parallel to the piston axis 11 can be seen there, with again a circular contact point, in the same way as in FIG. 10, wherein the soldering gap 9 according to FIG. 10 is again orientated perpendicularly to the piston axis 11, however.

As basic material for the piston parts 2, 3, for example an AFP steel 38MNVS6 according to DIN EN10267, with material number 1.1303, can be selected, whereas for the high-temperature soldering material 12 for example a nickel-based solder L-BN12 according to EN 1044 or DIN 8513 can be selected.

All embodiments of the piston 1 according to the invention and of the production method according to the invention share the common factor in this case that the zero gaps, previously known from the prior art, which ensued as a result of parallel and flat abutting surfaces can be completely avoided and as a result the connection quality is significantly increased.

The piston 1 according to the invention is used for example in a cylinder of an internal combustion engine 15.

The invention claimed is:

1. A method for producing a piston, comprising:

producing a piston top part and a piston bottom part each including an inner support element having an inner joining surface and an outer support element having an outer joining surface, wherein at least one of the inner joining surface of the piston top part, the inner joining surface of the piston bottom part, the outer joining surface of the piston top part, and the outer joining surface of the piston bottom part includes a solder depository;

pre-machining at least one of the inner joining surface of the piston top part, the inner joining surface of the piston bottom part, the outer joining surface of the piston top part, and the outer joining surface of the piston bottom part such that in a joined together state i) the inner joining surface of the piston top part and the inner joining surface of the piston bottom part, and ii) the outer joining surface of the piston top part and the outer joining surface of the piston bottom part do not butt flat against each other, and define a zero gap therebetween, introducing a high-temperature soldering material in at least one solder depository;

assembling the piston top part and the piston bottom part to form a piston body via creating at least one of circular contact and linear contact i) between the inner joining surface of the piston top part and the inner joining surface of the piston bottom part, and ii) between the outer joining surfaces of the piston top part and the outer joining surface of the piston bottom part such that a gap width is 20 μm to 150 μm;

transferring the piston body into a soldering oven;

melting the high-temperature soldering material via heating the piston body to a soldering temperature of approximately 1300° *C or less; and* cooling the piston body until the high-temperature soldering material has completely solidified.

2. The method according to claim 1, wherein assembling the piston top part and the piston bottom part to form the piston body includes creating a linear contact i) between the inner joining surface of the piston top part and the inner joining surface of the piston bottom part, and ii) between the outer joining surfaces of the piston top part and the outer joining surface of the piston bottom part such that a gap width is 20 μm to 80 μm.

3. The method according to claim 1, wherein melting the high-temperature soldering material includes heating the piston body at a pressure of $10^{-2}$ mbar or less.

4. A piston comprising:

a piston top part including an inner support element having an inner joining surface and an outer support element having an outer joining surface;

a piston bottom part including an inner support element having an inner joining surface and an outer support element having an outer joining surface, the piston bottom part arranged such that i) the inner joining surface of the piston bottom part and the inner joining surface of the piston top part contact one another in at least one of a circular manner and linear manner defining an inner gap of 20 μm to 150 μm therebetween, and ii) the outer joining surface of the piston bottom part and the outer joining surface of the piston top part contact one another in at least one of a circular manner and linear manner defining an outer gap of 20 μm to 150 μm therebetween;

at least one solder depository disposed in one of the inner joining surface of the piston top part, the inner joining surface of the piston bottom part, the outer joining surface of the piston top part, and the outer joining surface of the piston bottom part; and a solder seam composed of a high-temperature soldering material disposed within the at least one solder depository, the inner gap, and the outer gap, the solder seam connecting the piston top part and the piston bottom part to define a piston body.

5. The piston according to claim 4, wherein the at least one solder depository includes two solder depositories disposed in one of the inner joining surface of the piston top part, the inner joining surface of the piston bottom part, the outer joining surface of the piston top part, and the outer joining surface of the piston bottom part.

6. The piston according to claim 4, wherein at least one of:

one of the inner joining surface of the piston top part and the inner joining surface of the piston bottom part extends perpendicularly to a piston axis and the other of the inner joining surface of the piston top part and the inner joining surface of the piston bottom part extends obliquely to the piston axis; and one of the outer joining surface of the piston top part and the outer joining surface of the piston bottom part extends perpendicularly to the piston axis and the other of the outer joining surface of the piston top part and the outer joining surface of the piston bottom part extends obliquely to the piston axis.

7. The piston according to claim 4, wherein at least one of;

one of the inner joining surface of the piston top part and the inner joining surface of the piston bottom part extends perpendicularly to a piston axis and the other of the inner joining surface of the piston top part and the inner joining surface of the piston bottom part is configured kinked; and one of the outer joining surface of the piston top part and the outer joining surface of the piston bottom part extends perpendicularly to the piston axis and the other of the outer joining surface of the piston top part and the outer joining surface of the piston bottom part is configured kinked.

8. The piston according to claim 4, wherein at least one of:

one of the inner joining surface of the piston top part and the inner joining surface of the piston bottom part extends perpendicularly to a piston axis and the other of the inner joining surface of the piston top part and the inner joining surface of the piston bottom part is configured one of concave and convex; and one of the outer joining surface of the piston top part and the outer joining surface of the piston bottom part extends perpendicularly to the piston axis and the other of the outer joining surface of the piston top part and the outer joining surface of the piston bottom part is configured one of concave and convex.

9. The piston according to claim 4, wherein at least one of the inner joining surface of the piston top part, the inner joining surface of the piston bottom part, the outer joining surface of the piston top part, and the outer joining surface of the piston bottom part extends parallel to a piston axis and has a defined local projection.

10. An internal combustion engine comprising at least one cylinder and a piston arranged therein, the piston including:

a piston top part including an inner support element having an inner joining surface and an outer support element having an outer joining surface;

a piston bottom part including an inner support element having an inner joining surface and an outer support element having an outer joining surface, the piston bottom part arranged such that i) the inner joining surface of the piston bottom part and the inner joining surface of the piston top part contact one another in at least one of a circular manner and linear manner defining an inner gap of 20 μm to 150 μm therebetween, and ii) the outer joining surface of the piston bottom part and the outer joining surface of the piston top part contact one another in at least one of a circular manner and linear manner defining an outer gap of 20 μm to 150 μm therebetween;

at least one solder depository disposed in one of the inner joining surface of the piston top part, the inner joining surface of the piston bottom part, the outer joining surface of the piston top part, and the outer joining surface of the piston bottom part; and a solder seam composed of a high-temperature soldering material disposed within the at least one solder depository, the inner gap, and the outer gap, the solder seam connecting the piston top part and the piston bottom part to define a piston body.

11. The internal combustion engine according to claim 10, wherein at least one of:

one of the inner joining surface of the piston top part and the inner joining surface of the piston bottom part extends perpendicularly to a piston axis and the other of the inner joining surface of the piston top part and the inner joining surface of the piston bottom part extends obliquely to the piston axis; and one of the outer joining surface of the piston top part and the outer joining surface of the piston bottom part extends perpendicularly to the piston axis and the other of the outer joining surface of the piston top part and the outer joining surface of the piston bottom part extends obliquely to the piston axis.

12. The internal combustion engine according to claim 10, wherein at least one of:

one of the inner joining surface of the piston top part and the inner joining surface of the piston bottom part extends perpendicularly to a piston axis and the other of the inner joining surface of the piston top part and the inner joining surface of the piston bottom part is configured kinked; and one of the outer joining surface of the piston top part and the outer joining surface of the piston bottom part extends perpendicularly to the piston axis and the other of the outer joining surface of the piston top part and the outer joining surface of the piston bottom part is configured kinked.

13. The internal combustion engine according to claim 10, wherein at least one of:

one of the inner joining surface of the piston top part and the inner joining surface of the piston bottom part extends perpendicularly to a piston axis and the other of the inner joining surface of the piston top part and the inner joining surface of the piston bottom part is configured one of concave and convex; and one of the outer joining surface of the piston top part and the outer joining surface of the piston bottom part extends perpendicularly to the piston axis and the other of the outer joining surface of the piston top part and the outer joining surface of the piston bottom part is configured one of concave and convex.

14. The method according to claim 1, wherein melting the high-temperature soldering material includes evacuating at least a portion of a soldering oven gas from within the soldering oven.

15. The method according to claim 1, wherein producing the piston top part and the piston bottom part includes arranging the solder depository in at least one of the inner joining surface of the piston top part, the inner joining surface of the piston bottom part, the outer joining surface of the piston top part, and the outer joining surface of the piston bottom part such that a flow of the high-temperature soldering material is directed in a flow direction via a capillary effect when melting the high-temperature soldering material.

16. The method according to claim 1, wherein assembling the piston top part and the piston bottom part to form the piston body includes creating at least one of circular contact and linear contact such that the gap width is larger in a region of the piston body subjected to a lower load force during operation than another region of the piston body.

17. The piston according to claim 4, wherein:

a first solder depository of the at least one solder depository is disposed in one of the inner joining surface of the piston top part and the inner joining surface of the piston bottom part; and a second solder depository of the at least one solder depository is disposed in one of the outer joining surface of the piston top part and the outer joining surface of the piston bottom part.

18. The piston according to claim 4, wherein at least one gap of the inner gap and outer gap is configured larger in a region of the piston body subjected to a lower load force during operation than another region of the piston body.

19. The piston according to claim 4, wherein the at least one solder depository is arranged such that a flow of the high-temperature soldering material is directed in a flow direction when the high-temperature soldering material is melted to form the solder seam.

20. The piston according to claim 9, wherein the local projection extends perpendicular to the piston axis and abuts at least one of the inner joining surface of the piston top part, the inner joining surface of the piston bottom part, the outer joining surface of the piston top part, and the outer joining surface of the piston bottom part such that the local projection at least partially defines at least one of the inner gap and outer gap.

* * * * *